US009609917B2

(12) United States Patent
Dojan et al.

(10) Patent No.: US 9,609,917 B2
(45) **Date of Patent: *Apr. 4, 2017**

(54) ARTICLE OF FOOTWEAR INCORPORATING TENSILE STRANDS WITH AN ELONGATED CROSS-SECTIONAL SHAPE

(71) Applicant: NIKE, Inc., Beaverton, OR (US)

(72) Inventors: Frederick J. Dojan, Vancouver, WA (US); Shane S. Kohatsu, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 135 days.

This patent is subject to a terminal disclaimer.

(21) Appl. No.: 14/510,216

(22) Filed: Oct. 9, 2014

(65) Prior Publication Data

US 2015/0082661 A1 Mar. 26, 2015

Related U.S. Application Data

(60) Division of application No. 13/196,153, filed on Aug. 2, 2011, now Pat. No. 8,893,405, which is a (Continued)

(51) Int. Cl.
*A43B 13/14* (2006.01)
*A43B 23/02* (2006.01)
(Continued)

(52) U.S. Cl.
CPC ..... *A43C 11/002* (2013.01); *A43B 3/26* (2013.01); *A43B 5/06* (2013.01); *A43B 23/02* (2013.01);
(Continued)

(58) Field of Classification Search
CPC .. A43B 3/26; A43B 5/06; A43B 23/02; A43B 23/0235; A43B 23/0265; A43B 23/0275; A43C 1/00; A43C 11/002
(Continued)

(56) References Cited

U.S. PATENT DOCUMENTS 2,034,091 A 3/1936 Dunbar
2,048,294 A 7/1936 Roberts
(Continued)

FOREIGN PATENT DOCUMENTS

CN 101125044 2/2008
CN 101632502 1/2010
(Continued)

OTHER PUBLICATIONS

Response mailed Jul. 11, 2016 for Examination Report dated Jun. 15, 2016 in European Patent Application No. 12819662.3, 16 pages.
(Continued)

*Primary Examiner* — Jila M Mohandesi
(74) *Attorney, Agent, or Firm* — Klarquist Sparkman, LLP

(57) ABSTRACT

An article of footwear may have an upper and a sole structure secured to the upper. The upper includes a base layer and a plurality of strands. The base layer forms at least a portion of an exterior surface of the upper. The strands are located adjacent to the base layer and form another portion of the exterior surface of the upper, the strands being unsecured to the base layer for a distance of at least five centimeters, and the strands having an elongate cross-sectional shape.

20 Claims, 14 Drawing Sheets

Related U.S. Application Data continuation-in-part of application No. 12/505,740, filed on Jul. 20, 2009, now Pat. No. 8,312,645, which is a continuation-in-part of application No. 11/441,924, filed on May 25, 2006, now Pat. No. 7,870,681.

(51) Int. Cl.

| | |
|---|---|
| ***A43C 11/00*** | (2006.01) |
| ***A43B 3/26*** | (2006.01) |
| ***A43B 5/06*** | (2006.01) |
| ***A43C 1/00*** | (2006.01) |

(52) U.S. Cl.

CPC ..... *A43B 23/0235* (2013.01); *A43B 23/0265* (2013.01); *A43B 23/0275* (2013.01); *A43C 1/00* (2013.01)

(58) Field of Classification Search

USPC ..... 36/50.1, 51

See application file for complete search history.

(56) References Cited

U.S. PATENT DOCUMENTS

| | | | | |
|---|---|---|---|---|
| 2,108,415 | A | 2/1938 | Simister | |
| 2,205,356 | A | 6/1940 | Gruensfelder | |
| 2,311,996 | A | 2/1943 | Parker | |
| 3,131,490 | A | 5/1964 | Rowen | |
| 3,439,434 | A | 4/1969 | Tangorra | |
| 3,672,078 | A | 6/1972 | Fukuoka | |
| 3,823,493 | A | 7/1974 | Brehm et al. | |
| 4,627,369 | A | 12/1986 | Conrad et al. | |
| 4,634,616 | A | 1/1987 | Musante et al. | |
| 4,642,819 | A | 2/1987 | Ales et al. | |
| 4,756,098 | A | 7/1988 | Boggia | |
| 4,858,339 | A | 8/1989 | Hayafuchi et al. | |
| 4,873,725 | A | 10/1989 | Mitchell | |
| 5,016,327 | A | 5/1991 | Klausner | |
| 5,149,388 | A | 9/1992 | Stahl | |
| 5,156,022 | A | 10/1992 | Altman et al. | |
| 5,271,130 | A | 12/1993 | Batra | |
| 5,285,658 | A | 2/1994 | Altman et al. | |
| 5,345,638 | A | 9/1994 | Nishida | |
| 5,359,790 | A | 11/1994 | Iverson et al. | |
| 5,367,795 | A | 11/1994 | Iverson et al. | |
| 5,380,480 | A | 1/1995 | Okine et al. | |
| 5,399,410 | A | 3/1995 | Urase et al. | |
| 5,645,935 | A | 7/1997 | Kemper et al. | |
| 5,692,320 | A * | 12/1997 | Nichols | A43C 1/04 36/170 |
| D397,858 | S * | 9/1998 | Cass | D2/972 |
| 5,832,540 | A | 11/1998 | Knight | |
| D405,587 | S | 2/1999 | Merikoski | |
| 5,930,918 | A | 8/1999 | Healy et al. | |
| 5,990,378 | A | 11/1999 | Ellis | |
| 6,003,247 | A | 12/1999 | Steffe | |
| 6,004,891 | A | 12/1999 | Tuppin et al. | |
| 6,009,637 | A | 1/2000 | Pavone | |
| 6,029,376 | A | 2/2000 | Cass | |
| 6,038,702 | A | 3/2000 | Knerr | |
| 6,128,835 | A | 10/2000 | Ritter et al. | |
| 6,151,804 | A | 11/2000 | Hieblinger | |
| 6,164,228 | A | 12/2000 | Lin et al. | |
| 6,170,175 | B1 | 1/2001 | Funk | |
| 6,213,634 | B1 | 4/2001 | Harrington et al. | |
| 6,505,424 | B2 * | 1/2003 | Oorei | A43B 5/00 36/129 |
| 6,615,427 | B1 | 9/2003 | Hailey | |
| 6,665,958 | B2 | 12/2003 | Goodwin | |
| 6,718,895 | B1 | 4/2004 | Fortuna | |
| 6,860,214 | B1 | 3/2005 | Wang | |
| 6,910,288 | B2 | 6/2005 | Dua | |
| 7,086,179 | B2 | 8/2006 | Dojan et al. | |
| 7,086,180 | B2 | 8/2006 | Dojan et al. | |
| 7,100,310 | B2 | 9/2006 | Foxen et al. | |
| 7,293,371 | B2 | 11/2007 | Aveni | |
| 7,320,189 | B2 * | 1/2008 | Clark | A43B 3/24 36/50.1 |
| 7,337,560 | B2 | 3/2008 | Marvin et al. | |
| 7,343,701 | B2 * | 3/2008 | Pare | A43C 1/06 36/50.1 |
| 7,347,012 | B2 * | 3/2008 | Clark | A43B 1/14 36/50.1 |
| 7,574,818 | B2 | 8/2009 | Meschter | |
| 7,591,050 | B2 | 9/2009 | Hammerslag | |
| 7,631,440 | B2 * | 12/2009 | Keen | A43B 1/14 36/50.1 |
| 7,665,230 | B2 | 2/2010 | Dojan et al. | |
| 7,676,956 | B2 | 3/2010 | Dojan et al. | |
| 7,849,518 | B2 | 12/2010 | Moore | |
| 7,870,681 | B2 | 1/2011 | Meschter | |
| 7,870,682 | B2 | 1/2011 | Meschter et al. | |
| 8,312,645 | B2 | 11/2012 | Dojan et al. | |
| 8,312,646 | B2 | 11/2012 | Meschter et al. | |
| 8,631,589 | B2 | 1/2014 | Dojan | |
| 8,893,405 | B2 | 11/2014 | Dojan et al. | |
| 2001/0051484 | A1 | 12/2001 | Ishida et al. | |
| 2003/0178738 | A1 | 9/2003 | Staub et al. | |
| 2004/0074589 | A1 | 4/2004 | Gessler et al. | |
| 2004/0118018 | A1 | 6/2004 | Dua | |
| 2004/0142631 | A1 | 7/2004 | Luk | |
| 2004/0181972 | A1 | 9/2004 | Csorba | |
| 2004/0261295 | A1 | 12/2004 | Meschter | |
| 2005/0028403 | A1 | 2/2005 | Swigart et al. | |
| 2005/0115284 | A1 | 6/2005 | Dua | |
| 2005/0132609 | A1 | 6/2005 | Dojan et al. | |
| 2005/0268497 | A1 | 12/2005 | Alfaro et al. | |
| 2006/0048413 | A1 | 3/2006 | Sokolowski et al. | |
| 2006/0137221 | A1 | 6/2006 | Dojan et al. | |
| 2007/0199210 | A1 | 8/2007 | Vattes et al. | |
| 2007/0271821 | A1 | 11/2007 | Meschter | |
| 2008/0110049 | A1 | 5/2008 | Sokolowski et al. | |
| 2010/0018075 | A1 | 1/2010 | Meschter et al. | |
| 2010/0037483 | A1 | 2/2010 | Meschter et al. | |
| 2010/0043253 | A1 | 2/2010 | Dojan et al. | |
| 2010/0154256 | A1 | 6/2010 | Dua et al. | |
| 2010/0175276 | A1 | 7/2010 | Dojan et al. | |
| 2010/0251491 | A1 | 10/2010 | Dojan et al. | |
| 2010/0251564 | A1 | 10/2010 | Meschter | |
| 2011/0041359 | A1 | 2/2011 | Dojan et al. | |
| 2012/0023778 | A1 | 2/2012 | Dojan et al. | |
| 2012/0023786 | A1 | 2/2012 | Dojan | |

FOREIGN PATENT DOCUMENTS

| | | | |
|---|---|---|---|
| DE | 20215559 | U1 | 1/2003 |
| EP | 0082824 | A2 | 6/1983 |
| EP | 0818289 | A2 | 1/1998 |
| FR | 1462349 | A | 2/1967 |
| FR | 2046671 | A5 | 3/1971 |
| FR | 2457651 | A1 | 12/1980 |
| WO | 9843506 | A1 | 10/1998 |
| WO | 03013301 | A1 | 2/2003 |
| WO | 2004089609 | A1 | 10/2004 |
| WO | 2007139567 | A1 | 12/2007 |
| WO | 2007140055 | A2 | 12/2007 |

OTHER PUBLICATIONS

Chinese Office Action dated Apr. 24, 2015 in Chinese Patent Application No. 201280037060.X.

International Preliminary Report on Patentability (including Written Opinion of the ISA) for Application No. PCT/US2012/046786 mailed on Feb. 13, 2014.

International Search Report and Written Opinion for Application No. PCT/US2012/046786, mailed on May 6, 2013.

Examination Report mailed Jun. 15, 2016 for European Patent Application No. 12819662.3 filed Jul. 13, 2012, 4 pages.

* cited by examiner

ARTICLE OF FOOTWEAR INCORPORATING TENSILE STRANDS WITH AN ELONGATED CROSS-SECTIONAL SHAPE

CROSS-REFERENCE TO RELATED APPLICATIONS

This application is a division of U.S. patent application Ser. No. 13/196,153, filed on Aug. 2, 2011 and entitled "Article of Footwear Incorporating Tensile Strands with an Elongated Cross-Sectional Shape", which issued as U.S. Pat. No. 8,893,405 on Nov. 25, 2014, which application is a continuation-in-part application and claims priority under 35 U.S.C. §120 to U.S. patent application Ser. No. 12/505,740, which was filed in the U.S. Patent and Trademark Office on 20 Jul. 2009 and entitled "Material Elements Incorporating Tensile Strands", which issued on Nov. 20, 2012 as U.S. Pat. No. 8,312,645, such prior applications being entirely incorporated herein by reference. In turn, U.S. patent application Ser. No. 12/505,740 is a continuation-in-part application and claims priority under 35 U.S.C. §120 to U.S. patent application Ser. No. 11/441,924, which was filed in the U.S. Patent and Trademark Office on 25 May 2006 and entitled "Article Of Footwear Having An Upper With Thread Structural Elements", which issued on Jan. 18, 2011 as U.S. Pat. No. 7,870,681, such prior U.S. Patent Application being entirely incorporated herein by reference.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The various material elements forming the upper impart specific properties to different areas of the upper. For example, textile elements may provide breathability and may absorb moisture from the foot, foam layers may compress to impart comfort, and leather may impart durability and wear-resistance. As the number of material elements increases, the overall mass of the footwear may increase proportionally. The time and expense associated with transporting, stocking, cutting, and joining the material elements may also increase. Additionally, waste material from cutting and stitching processes may accumulate to a greater degree as the number of material elements incorporated into an upper increases. Moreover, products with a greater number of material elements may be more difficult to recycle than products formed from fewer material elements. By decreasing the number of material elements, therefore, the mass of the footwear and waste may be decreased, while increasing manufacturing efficiency and recyclability.

The sole structure is secured to a lower portion of the upper so as to be positioned between the foot and the ground.

In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

SUMMARY

An article of footwear is disclosed below as having an upper and a sole structure secured to the upper. The upper includes a base layer and a plurality of strands. The base layer forms at least a portion of an exterior surface of the upper. The strands are located adjacent to the base layer and form another portion of the exterior surface of the upper, the strands being unsecured to the base layer for a distance of at least five centimeters, and the strands having an elongate cross-sectional shape.

The elongate cross-sectional shape may include (a) a pair of facing surfaces located opposite each other and (b) a pair of end surfaces located opposite each other. A dimension between the facing surfaces defines a thickness, and a dimension between the end surfaces defines a width, the width being greater than the thickness. In some configurations, one of the facing surface is oriented to face the base layer, or one of the end surfaces is oriented to face the upper. In some configurations, a ratio of the width to the thickness is greater than 1.3, or the ratio of the width to the thickness is greater than two. In some configurations, the strands are unsecured to the base layer for the distance of at least five centimeters in an area between the lace region and the lower region.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

BRIEF DESCRIPTION OF THE DRAWINGS

The foregoing Summary and the following Detailed Description will be better understood when read in conjunction with the accompanying figures.

DETAILED DESCRIPTION

Figure 1:
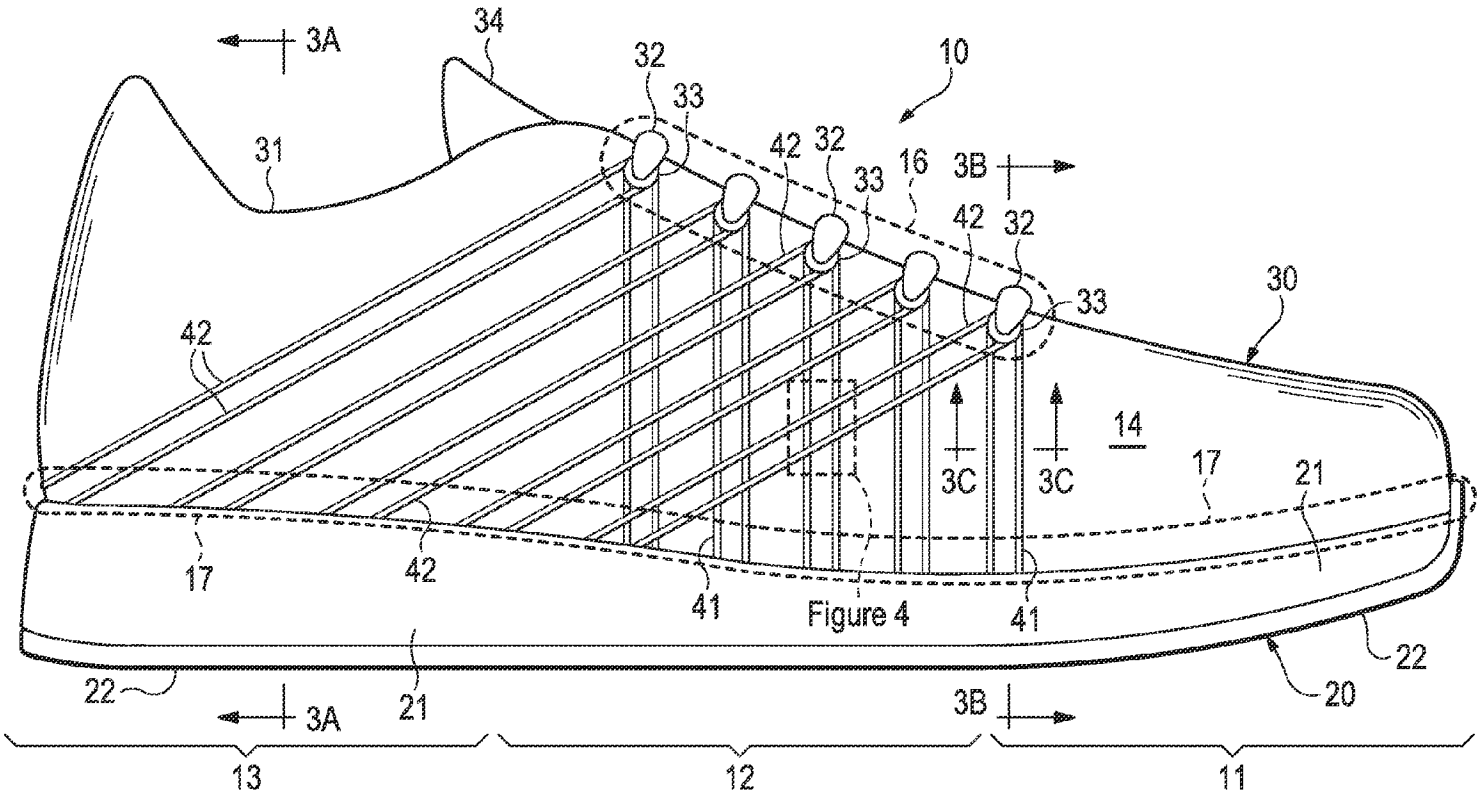
FIG. 1 is a lateral side elevational view of an article of footwear.

The following discussion and accompanying figures disclose an article of footwear having an upper that includes tensile strand elements. The article of footwear is disclosed as having a general configuration suitable for walking or running. Concepts associated with the footwear, including the upper, may also be applied to a variety of other athletic footwear types, including baseball shoes, basketball shoes, cross-training shoes, cycling shoes, football shoes, tennis shoes, soccer shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

General Footwear Structure

An article of footwear 10 is depicted in FIGS. 1, 2, 3A, and 3B as including a sole structure 20 and an upper 30. For reference purposes, footwear 10 may be divided into three general regions: a forefoot region 11, a midfoot region 12, and a heel region 13. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Sole structure 20 is secured to upper 30 and extends between the foot and the ground when footwear 10 is worn. The primary elements of sole structure 20 are a midsole 21, an outsole 22, and an sockliner 23. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate fluid-filled chambers, plates, moderators, or other elements that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. Sockliner 23 is located within upper 30 and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

The various portions of upper 30 may be formed from one or more of a plurality of material elements (e.g., textiles, polymer sheets, foam layers, leather, synthetic leather) that are stitched or bonded together to form a void within footwear 10 for receiving and securing a foot relative to sole structure 20. The void is shaped to accommodate the foot and extends along the lateral side of the foot, along the medial side of the foot, over the foot, around the heel, and under the foot. Access to the void is provided by an ankle opening 31 located in at least heel region 13. A lace 32 extends through various lace apertures 33 and permits the wearer to modify dimensions of upper 30 to accommodate the proportions of the foot. More particularly, lace 32 permits the wearer to tighten upper 30 around the foot, and lace 32 permits the wearer to loosen upper 30 to facilitate entry and removal of the foot from the void (i.e., through ankle opening 31). As an alternative to lace apertures 33, upper 30 may include other lace-receiving elements, such as loops, eyelets, and D-rings. In addition, upper 30 includes a tongue 34 that extends between the interior void and lace 32 to enhance the comfort of footwear 10. In some configurations, upper 30 may incorporate a heel counter that limits heel movement in heel region 13 or a wear-resistant toe guard located in forefoot region 11.

Figure 3A:
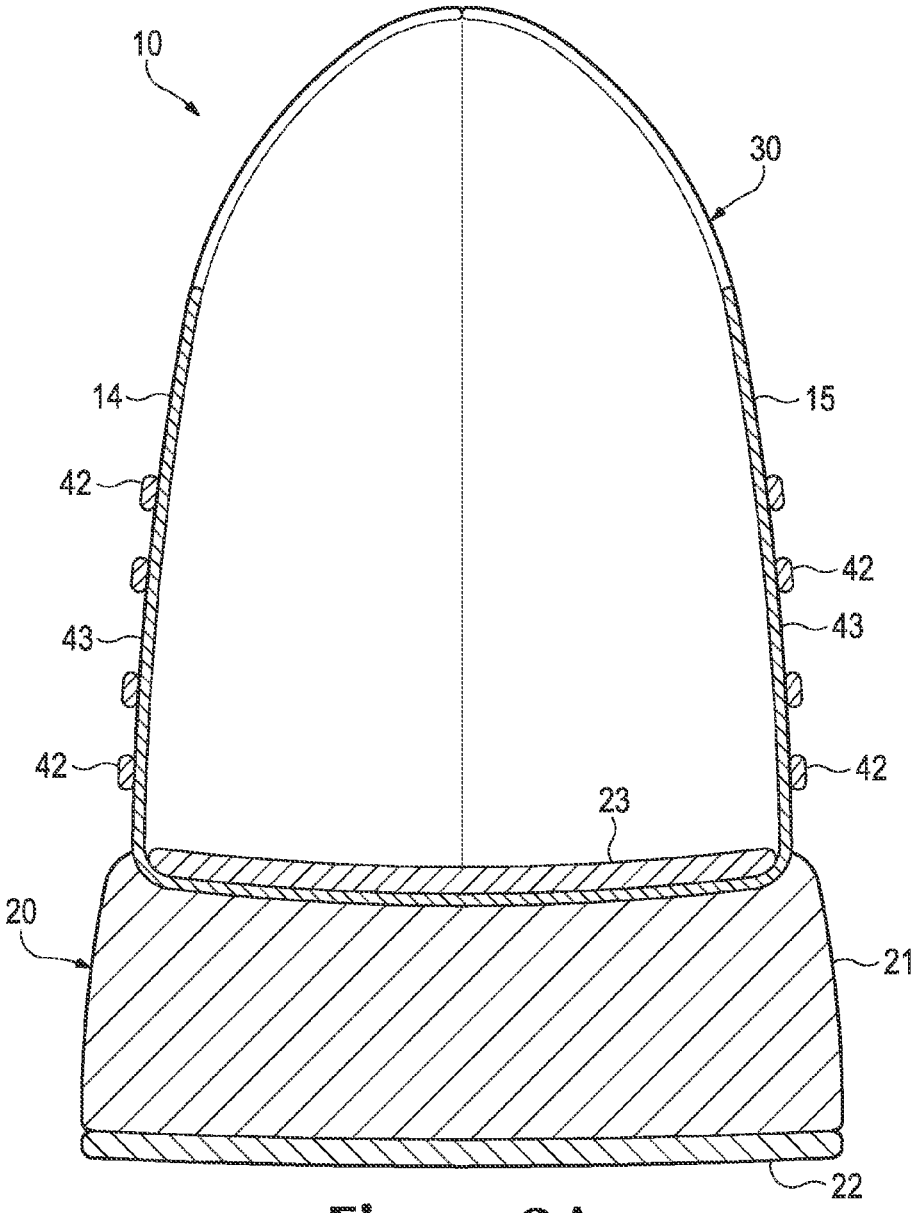
FIGS. 3A-3C are cross-sectional views of the article of footwear, as defined by section lines 3A-3C in FIG. 1.
Figure 3B:
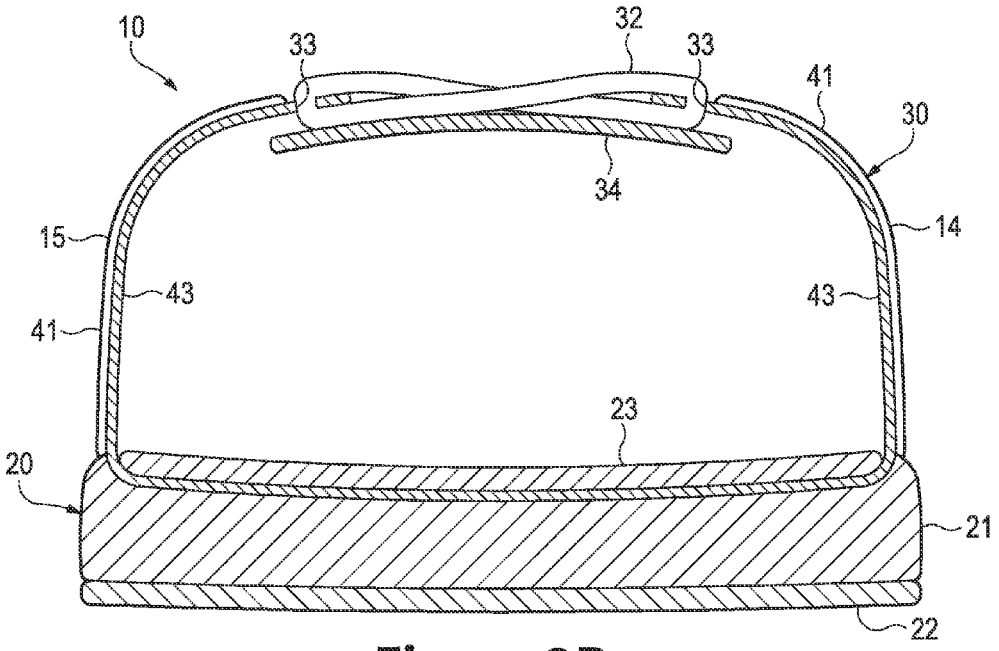
Figure 4:
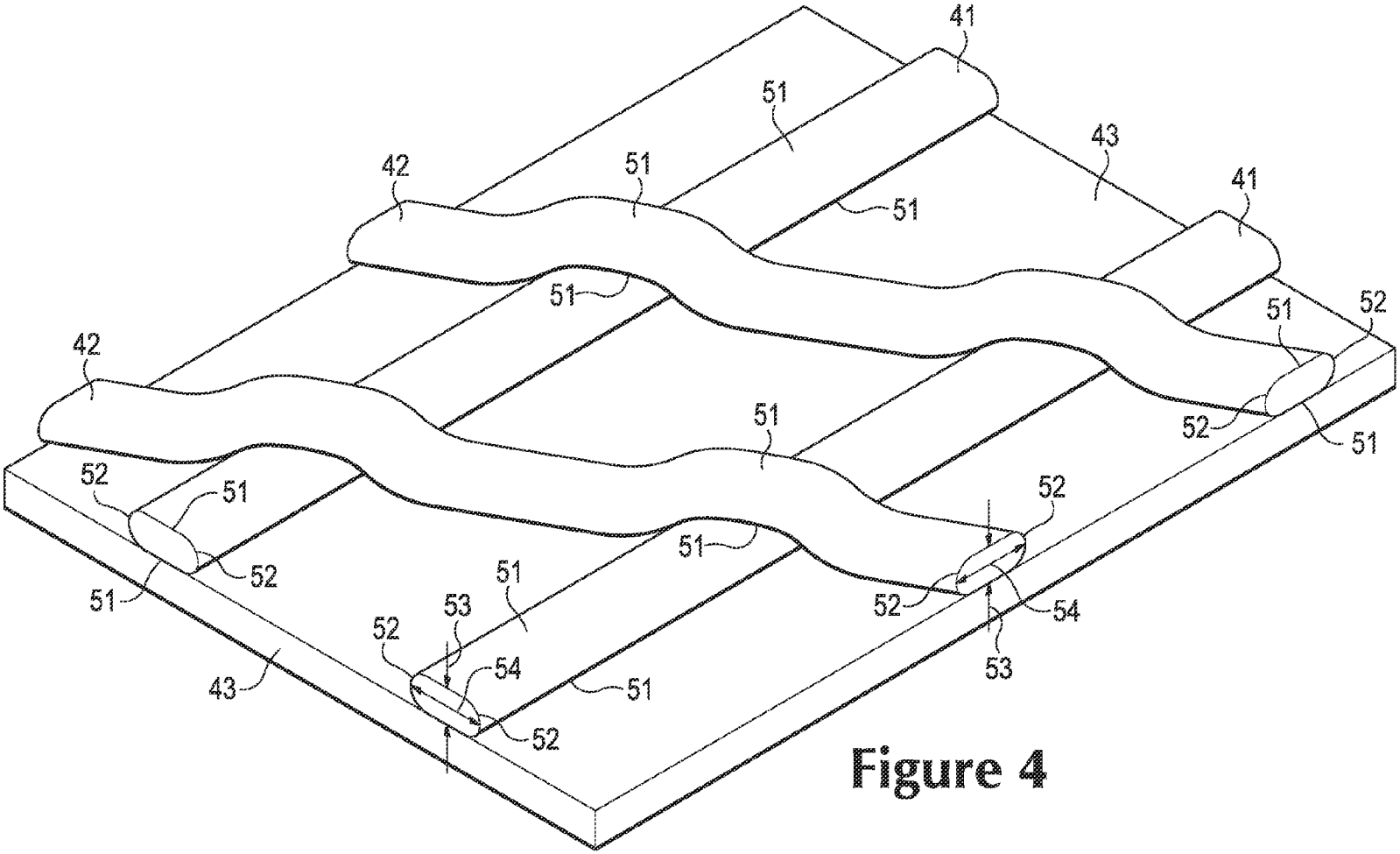
FIG. 4 is a perspective view of a portion of the article of footwear, as defined in FIG. 1.

A variety of material elements or other components may be incorporated into upper 30, as discussed above. In addition, areas of one or both of lateral side 14 and medial side 15 incorporate various first strands 41 and second strands 42, as depicted in FIGS. 3A, 3B, and 4. When incorporated into upper 30, strands 41 and 42 are located exterior of a base layer 43. Whereas base layer 43 forms a surface of the void within upper 30, a combination of base layer 43 and strands 41 and 42 forms a portion of an exterior or exposed surface of upper 30. The combination of first strands 41, second strands 42, and base layer 43 may, therefore, form substantially all of a thickness of upper 30 in some areas. In further configurations, other material elements may be located inward or outward from base layer 43 and strands 41 and 42. As one example, a polymer foam layer and a textile layer may be located inward of base layer 43, with the textile layer forming a portion of the void. As another example, a mesh textile layer may be located exterior of strands 41 and 42.

Figure 2:
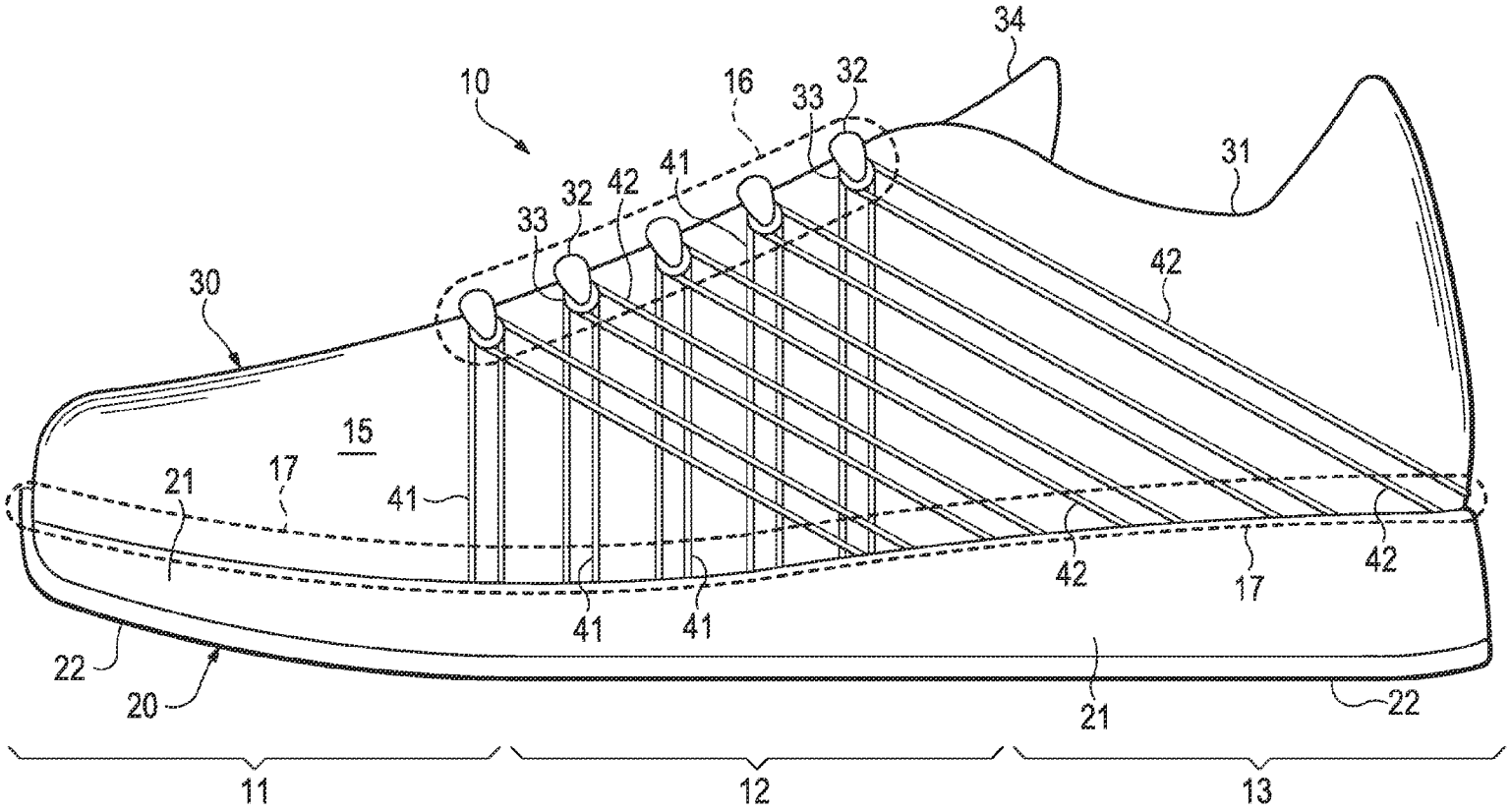
FIG. 2 is a medial side elevational view of the article of footwear.

A lace region 16 and a lower region 17 are defined in FIGS. 1 and 2. Lace region 16 generally encompasses an area where lace apertures 33 or other lace-receiving elements are located, and lower region 17 generally encompasses an area where upper 30 joins with sole structure 20. Regions 16 and 17 are not intended to demarcate precise areas of footwear 10, including upper 30. Rather, regions 16 and 17 are intended to represent general areas to aid in the following discussion.

Strand Configuration

The locations and orientations of strands 41 and 42 may vary significantly. As an example, FIGS. 1 and 2 depict strands 41 and 42 as extending downward from lace apertures 33 and toward sole structure 20. More particularly, strands 41 and 42 extend from lace region 16 to lower region 17. During activities that involve walking, running, or other ambulatory movements, a foot within the void in footwear 10 may tend to stretch areas of upper 30. That is, many of the material elements forming upper 30 may stretch due to movements of the foot. Although strands 41 and 42 may also stretch, strands 41 and 42 generally stretch to a lesser degree than the other material elements forming upper 30 (e.g., base layer 43). Each of strands 41 and 42 may be located, therefore, to form structural components in upper 30 that (a) resist stretching in specific directions or locations, (b) limit excess movement of the foot relative to sole structure 20 and upper 30, (c) retain proper position of the foot relative to sole structure 20 and upper 30, and (d) reinforce locations where forces are concentrated.

Whereas first strands 41 are oriented in a generally vertical direction in an area between regions 16 and 17, second strands 42 are oriented in a rearwardly-angled direction in the area between regions 16 and 17. That is, strands 41 and 42 are angled with respect to each other. A similar configuration is disclosed in U.S. Patent Application Publication Number 2012/0023778, which was filed in the U.S. Patent and Trademark Office on 30 Jul. 2010 under U.S. patent application Ser. No. 12/847,836 and entitled "Footwear Incorporating Angled Tensile Strand Elements", such application being incorporated herein by reference. The orientations for strands 41 and 42 assist, for example, with cutting motions (i.e., side-to-side movements of the wearer) and braking motions (i.e., slowing the forward momentum of the wearer). More particularly, first strands 41 resist stretch in upper 30 due to cutting motions and ensure that the foot remains properly positioned relative to footwear 10, and second strands 42 resist stretch in upper 30 due to braking motions, as well as jumping and running motions that flex or otherwise bend footwear 10. As discussed in greater detail below, strands 41 and 42 may be oriented in other ways and located in other areas of upper 30. Accordingly, the configuration of first strands 41 and second strands 42 in FIGS. 1 and 2 is intended to provide an example of a suitable configuration for footwear 10.

Portions of strands 41 and 42 may be unsecured to base layer 43. In general, strands 41 and 42 are joined with base layer 43 or have a fixed position in regions 16 and 17. In the area between regions 16 and 17, however, strands 41 and 42 may be loose or otherwise unsecured to base layer 43. In some configurations, strands 41 and 42 may be loose for a distance of at least five centimeters. A similar configuration is disclosed in U.S. Pat. No. 8,631,589, which was filed in the U.S. Patent and Trademark Office on 30 Jul. 2010 under U.S. patent application Ser. No. 12/847,860 and entitled "Article Of Footwear Incorporating Floating Tensile Strands", such application being incorporated herein by reference. An advantage to a configuration wherein strands 41 and 42 are loose is that each of strands 41 and 42 may tension, bend, move, or otherwise operate in a generally independent manner within footwear 10.

Figure 3C:
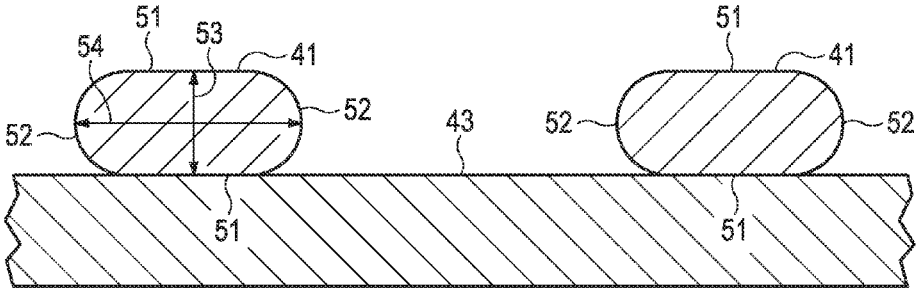

Strands 41 and 42 may have the configuration of various filaments, fibers, yarns, threads, ropes, cables, or wires formed from various materials. Many conventional strands have a generally round cross-sectional shape. In contrast, strands 41 and 42 are depicted in FIGS. 3A, 3C, and 4 as having generally elongate cross-sectional shape, rather than round. In this configuration, the elongate cross-sectional shape defines two facing surfaces 51 and two end surfaces 52. Facing surfaces 51 are located opposite each other and have a generally planar or extended shape. As oriented, one of facing surfaces 51 contacts and lays against base layer 43, and the other of facing surfaces 51 faces outward and away from base layer 43. As such, facing surfaces 51 may be parallel to base layer 43. End surfaces 52 are also located opposite each other and have a generally rounded shape. As oriented, end surfaces 52 face along base layer 43 and toward forefoot region 11 and heel region 13. As an additional matter, a distance between facing surfaces 51 defines a thickness 53 of strands 41 and 42, and a distance between end surfaces 52 defines a width 54 of strands 41 and 42. In comparison, thickness 53 is less than width 54, thereby imparting the elongate cross-sectional shape to strands 41 and 42.

As utilized herein, "cross-sectional shape" is determined through a cross-section that is generally perpendicular to surfaces 51 and 52, rather than at an angle with respect to surfaces 51 and 52. Additionally, an "elongate cross-sectional shape" has a ratio of width to thickness (e.g., width 54 and thickness 53) of at least 1.3 to provide noticeable elongation. In many configurations the ratio of width to thickness will exceed two and may be greater than three or four.

The elongate cross-sectional shape and orientation of strands 41 and 42 imparts various advantages to footwear 10. As discussed above, strands 41 and 42 may form structural components in upper 30 that resist stretching, limit foot movement, retain proper foot positioning, and reinforce locations. During activities that involve walking, running, or other ambulatory movements, therefore, strands 41 and 42 are placed in tension and lay securely against the exterior surface of base layer 43. When placed in tension and laying against base layer 43, strands 41 and 42 may tend to press inward on base layer 43 and against the foot. That is, strands 41 and 42 may form pressure points that press into the foot. The elongate cross-sectional shape of strands 41 and 42, however, distributes forces over a relatively wide area and reduces the degree to which strands 41 and 42 press into the foot. In other words, the generally planar and extended shape of facing surfaces 51 distributes forces over a greater area, thereby enhancing the comfort of footwear 10.

Figure 5:
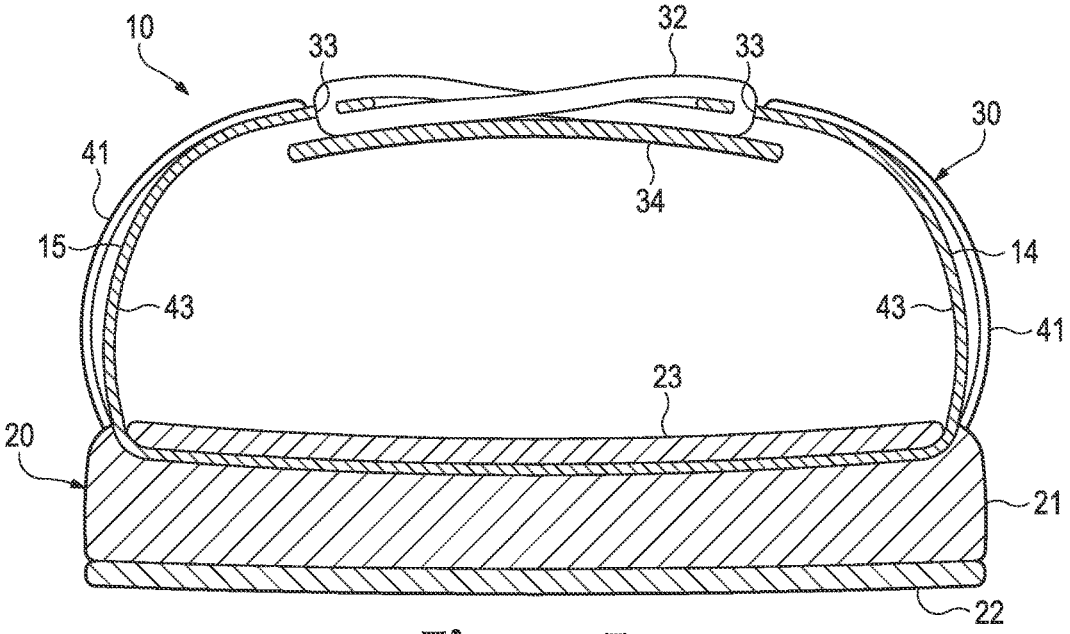
FIG. 5 is a cross-sectional view corresponding with FIG. 3B and depicting the article of footwear in a compressed configuration.

Further advantages of the elongate cross-sectional shape and orientation of strands 41 and 42 relates to the movement or deflection of strands 41 and 42. When not in tension or slightly compressed, strands 41 and 42 tend to bow, bend, or otherwise deflect relative to base layer 43. Given the different dimensions between thickness 53 and width 54, strands 41 and 42 tend to bow outward and away from base layer 43, as depicted in FIG. 5. That is, strands 41 and 42 tend to deflect in a direction that is perpendicular to facing surfaces 51, which corresponds with a direction that is outward and away from base layer 43, rather than side-to-side and along the surface of base layer 43. A first benefit of the outward deflection is that strands 41 and 42 are restrained from sideways movement and remain properly positioned relative to each other when not in tension or slightly compressed. A second benefit of the outward deflection relates to the aesthetics of footwear 10. More particularly, strands 41 and 42 remain properly positioned relative to each other when (a) on display in a retail environment and (b) when removed from a box or other packaging.

Another advantage of the elongate cross-sectional shape and orientation of strands 41 and 42 relates to the profile of footwear 10. The area of the cross-sectional shape has a direct relationship with the overall strength of strands 41 and 42. In general, a strand with a round cross-sectional shape and a strand with an elongate cross-sectional shape will have substantially equal strengths if the areas of the cross-sectional shapes are equal and the materials are identical. In comparison with a diameter of a round cross-sectional shape, however, thickness 53 is less due to the elongate cross-sectional shape of strands 41 and 42. As a result, strands 41 and 42 protrude outward from base layer 43 to a lesser extent than round strands, which may offer the benefits of protecting strands 41 and 42 and reducing the probability that strands 41 and 42 will catch on other objects or be snagged by the objects.

First strands 41 and second strands 42 may be formed from any material exhibiting a length that is substantially greater than a width and a thickness. As such, suitable materials for strands 41 and 42 include various filaments, fibers, yarns, threads, cables, or ropes that are formed from rayon, nylon (e.g., 6.6 nylon), polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Whereas filaments have an indefinite length and may be utilized individually as strands 41 and 42, fibers have a relatively short length and generally go through spinning or twisting processes to produce a strand of suitable length. An individual filament utilized in strands 41 and 42 may be formed form a single material (i.e., a monocomponent filament) or from multiple materials (i.e., a bicomponent filament). Similarly, different filaments may be formed from different materials. As an example, yarns utilized as strands 41 and 42 may include filaments that are each formed from a common material, may include filaments that are each formed from two or more different materials, or may include filaments that are each formed from two or more different materials. Similar concepts also apply to threads, cables, or ropes. The thickness of strands 41 and 42 may also vary significantly to range from less than 0.03 millimeters to more than 5 millimeters, for example. Accordingly, a variety of materials may be utilized for strands 41 and 42.

Various manufacturing processes may be utilized to form upper 30 and incorporate strands 41 and 42. As examples, the various manufacturing processes discussed in U.S. Pat. No. 8,631,589, which was filed in the U.S. Patent and Trademark Office on 30 Jul. 2010 under U.S. patent application Ser. No. 12/847,860 and entitled "Article Of Footwear Incorporating Floating Tensile Strands", may be utilized.

Further Footwear Configurations

Figure 6A:
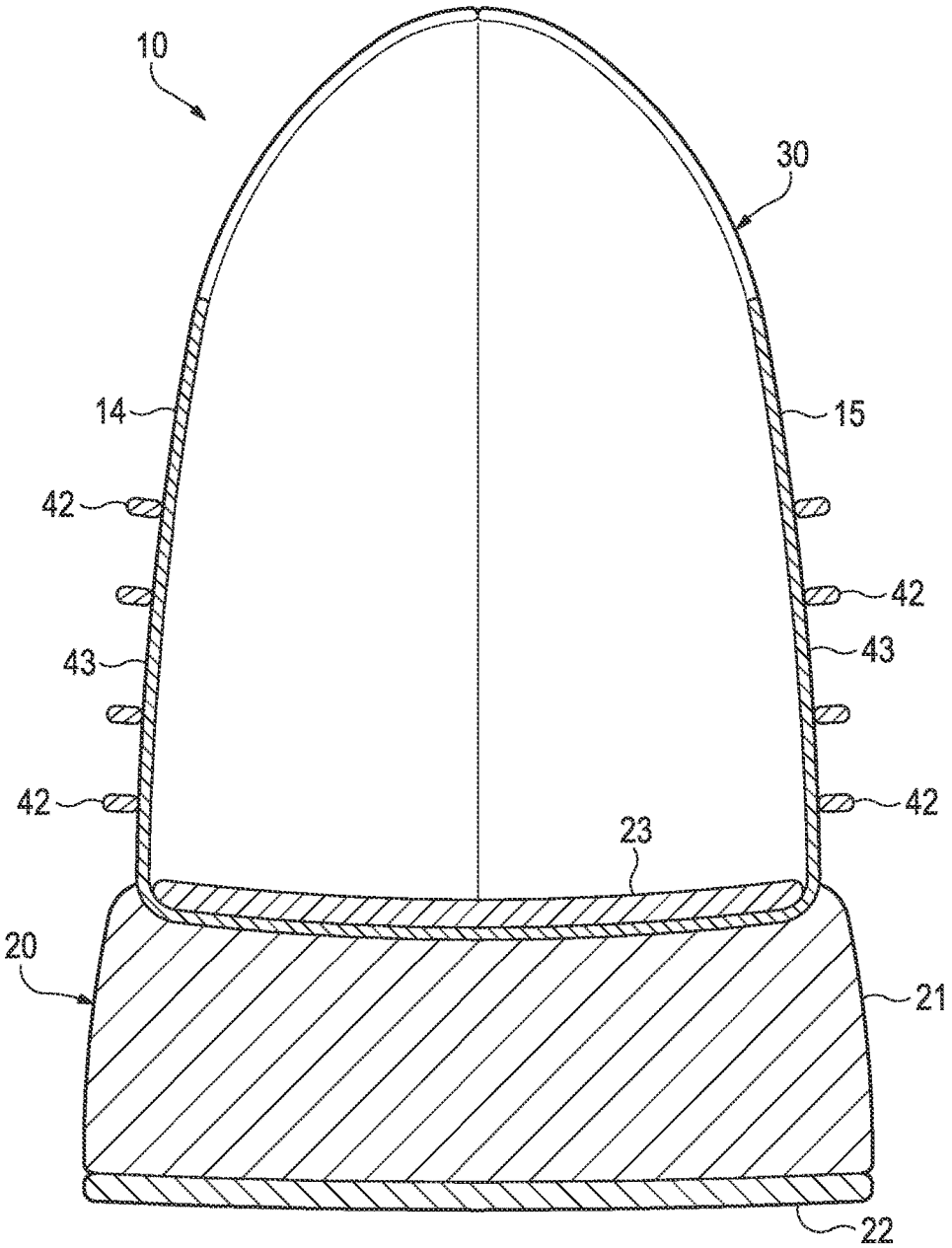
FIGS. 6A and 6B are cross-sectional views corresponding respectively with FIGS. 3A and 3C and depicting another configuration of the article of footwear.
Figure 6B:
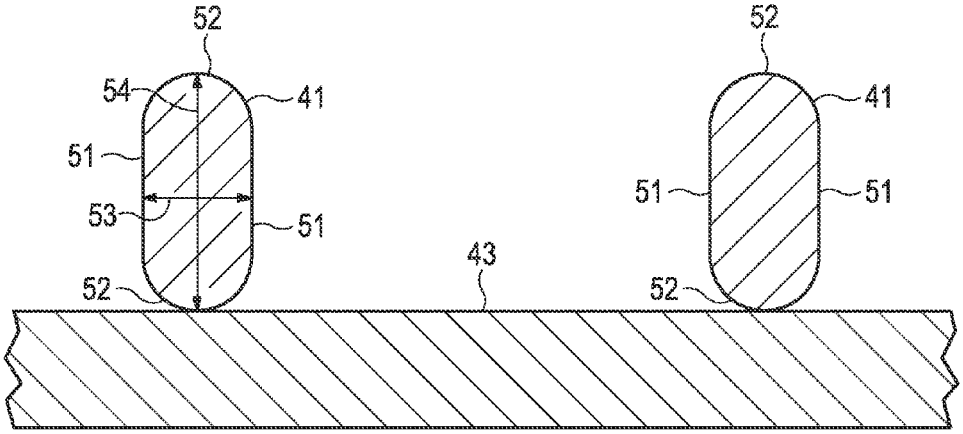

The orientations, locations, and quantity of strands 41 and 42 in FIGS. 1 and 2 are intended to provide an example of a suitable configuration for footwear 10. In other configurations of footwear 10, strands 41 and 42 may be oriented differently, strands 41 and 42 may extend through other areas of footwear 10, various strands 41 and 42 may be absent, or additional strands 41 and 42 may be present to provide further structural components in footwear 10. Referring to FIGS. 6A and 6B, for example, strands 41 and 42 are oriented such that (a) facing surfaces 51 face along base layer 43, (b) one of end surfaces 52 contacts and lays against base layer 43, and (c) the other of end surfaces 52 faces outward and away from base layer 43.

Figure 7A:
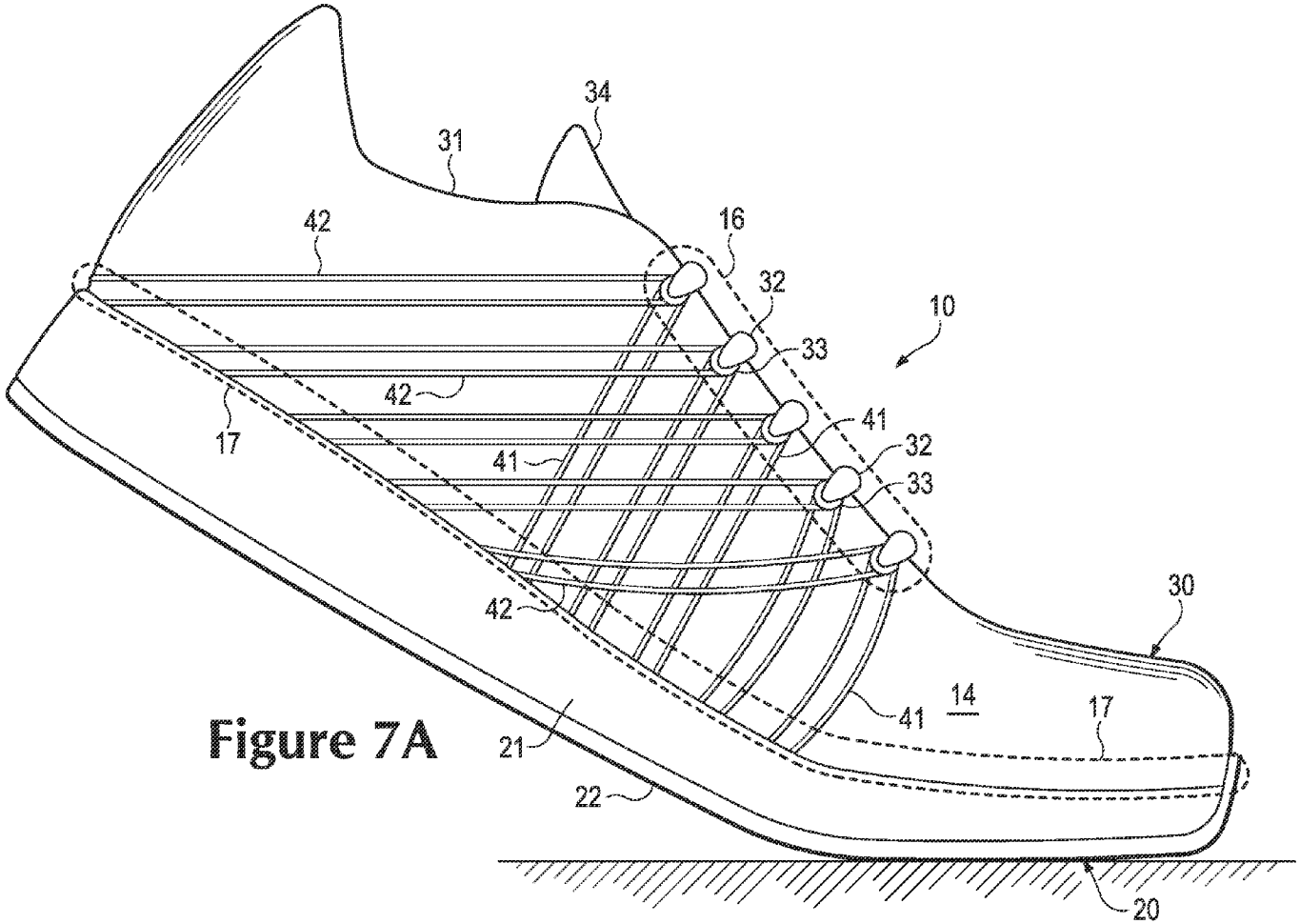
FIGS. 7A and 7B are lateral side elevational views of the article of footwear, as configured in FIGS. 6A and 6B, in flexed states.
Figure 7B:
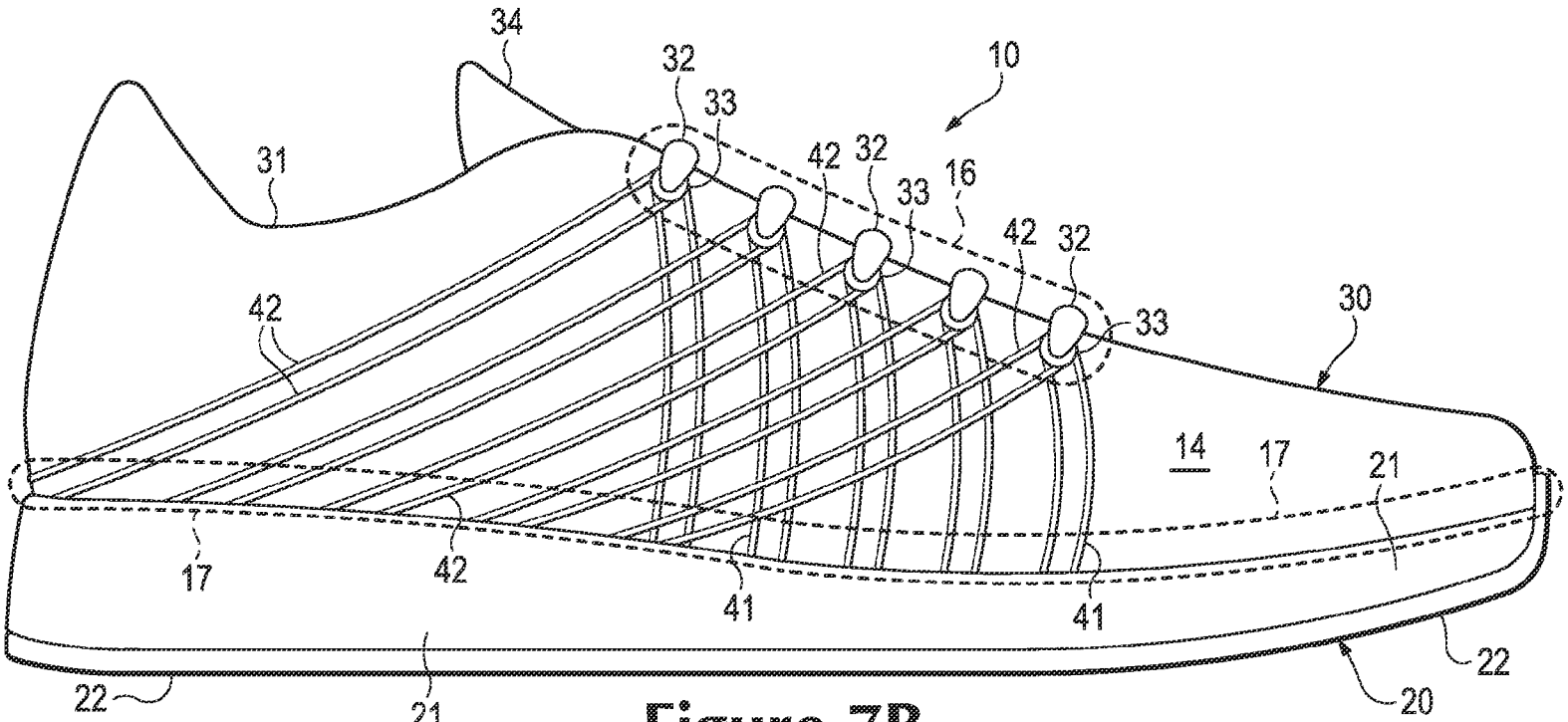

FIGS. 7A and 7B depict an advantage of orienting facing surfaces 51 to face along base layer 43. In addition to stretching upper 30, a foot within the void in footwear 10 may tend to bend, twist, or otherwise deform areas of upper 30 during activities that involve walking, running, or other ambulatory movements. That is, many of the material elements forming upper 30 may deform due to movements of the foot. As discussed above, strands 41 and 42 may be loose or otherwise unsecured to base layer 43 in the area between regions 16 and 17. When upper 30 is deformed, loose sections of strands 41 and 42 may bend, bow, or otherwise move relative to the surface of base layer 43. Referring to FIGS. 7A and 7B, for example, deformation of footwear 10 induces some of strands 41 and 42 to deform. More particularly, FIG. 7A depicts heel region 13 and midfoot region 12 as flexing upward relative to forefoot region 11. When flexed in this manner, strands 41 and 42 located closer to forefoot region 11 may bend, bow, or otherwise move. Specifically, selected strands 41 and 42 are depicted as bowing toward forefoot region 11. FIG. 7B depicts footwear 10 as deforming toward lateral side 14, which may occur during cutting motions (i.e., side-to-side movements of the wearer) or when the ankle rolls toward lateral side 14. When deformed in this manner, strands 41 and 42 throughout lateral side 14 may bend, bow, or otherwise move. Specifically, almost all of strands 41 and 42 on lateral side 14 are depicted as bowing toward forefoot region 11.

In the configuration of FIGS. 6A, 6B, 7A, and 7B, strands 41 and 42 will tend to bend or bow along the surface of base layer 43, rather than outward from the surface of base layer 43. That is, strands 41 and 42 will tend to bend or bow in a direction that extends along the exterior surface of upper 30. Referring to FIGS. 7A and 7B, for example, strands 41 and 42 bend along the exterior surface of upper 30 and toward forefoot region 11. Configuring strands 41 and 42 to bend or bow in a direction that extends along the exterior surface of upper 30 imparts various advantages to footwear 10. For example, strands 41 and 42 lay against base layer 43 and do not protrude significantly from base layer 43 when upper 30 is deformed due to movements of the foot. As a result, strands 41 and 42 remain close to upper 30, which may offer the benefits of protecting strands 41 and 42 and reducing the probability that strands 41 and 42 will catch on other objects or be snagged by the objects.

Figure 8A:
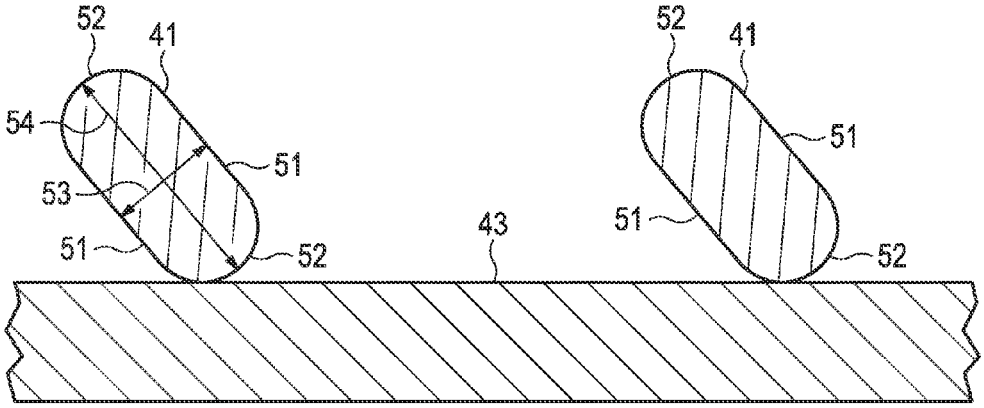
FIGS. 8A and 8B are cross-sectional views corresponding with FIG. 3C and depicting additional orientations of the strands.
Figure 8B:
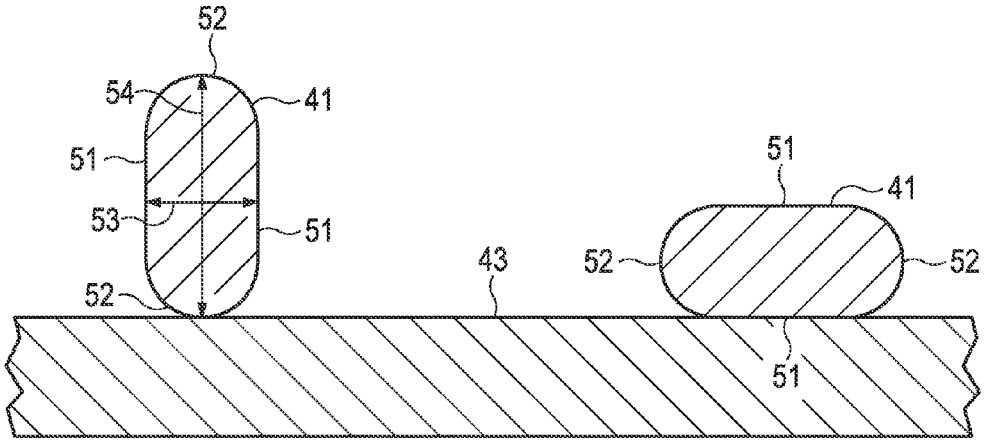
Figure 9A:
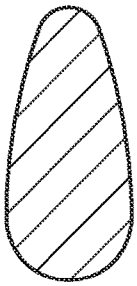
FIGS. 9A-9D are various cross-sectional shapes of strands from the article of footwear.
Figure 9B:
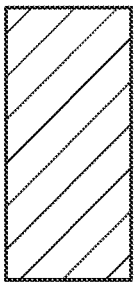
Figure 9C:
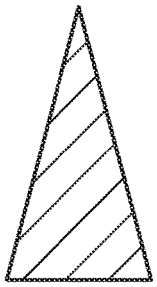
Figure 9D:
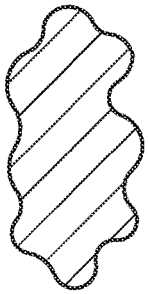

The orientation and cross-sectional shapes of strands 41 and 42 may vary to impart different properties and advantages to footwear 10. As another example, FIG. 8A depicts a configuration wherein strands 41 are oriented diagonally with respect to base layer 43. Additionally, FIG. 8B depicts a configuration wherein strands 41 are oriented differently with respect to base layer 43. With regard to cross-sectional shape, FIG. 9A depicts an elliptical configuration, FIG. 9B depicts a rectangular configuration, and FIG. 9C depicts a triangular configuration. In addition to elongate and regular cross-sectional shapes, strands 41 and 41 may also have an elongate and irregular cross-sectional shape, as depicted in FIG. 9D.

Figure 10A:
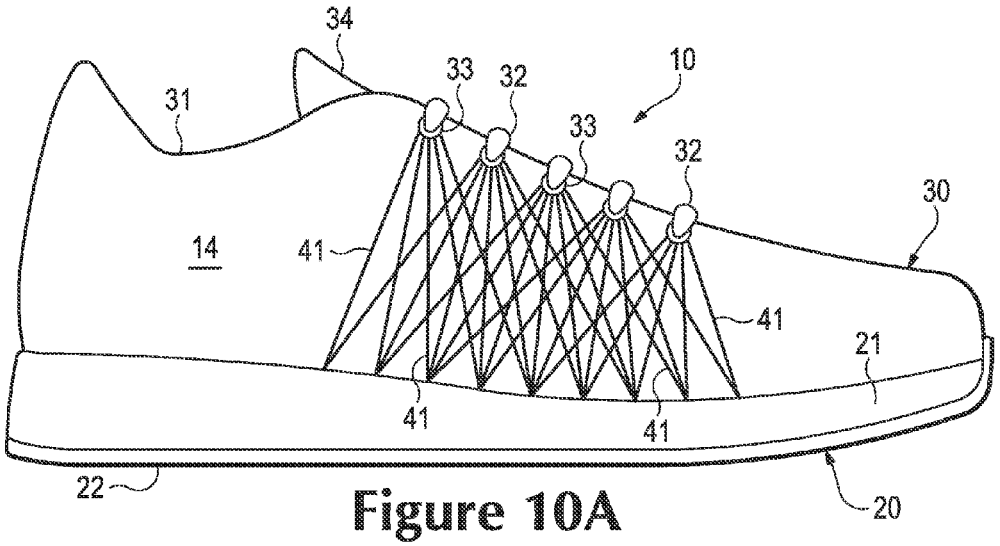
FIGS. 10A-10D are lateral side elevational views corresponding with FIG. 1 and depicting further configurations of the article of footwear.
Figure 10B:
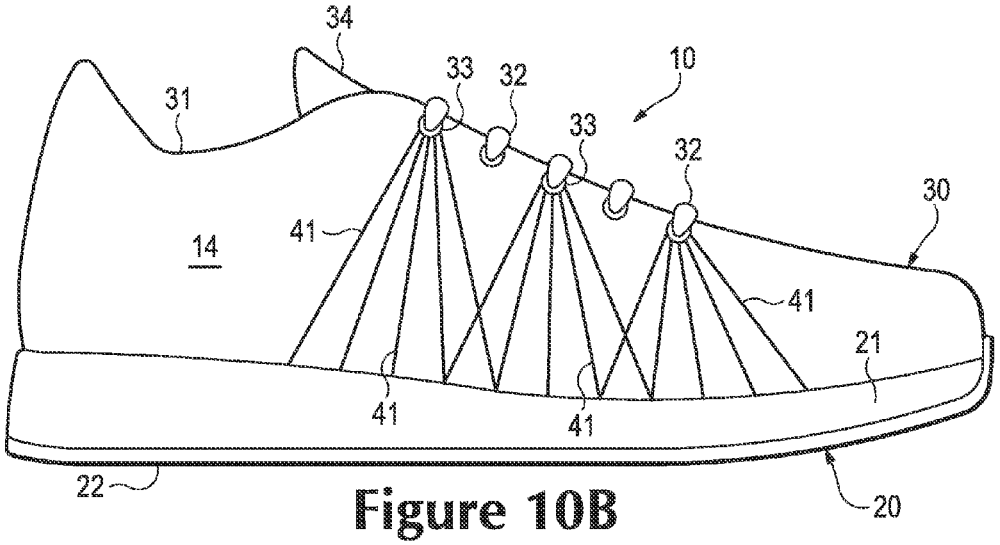
Figure 10C:
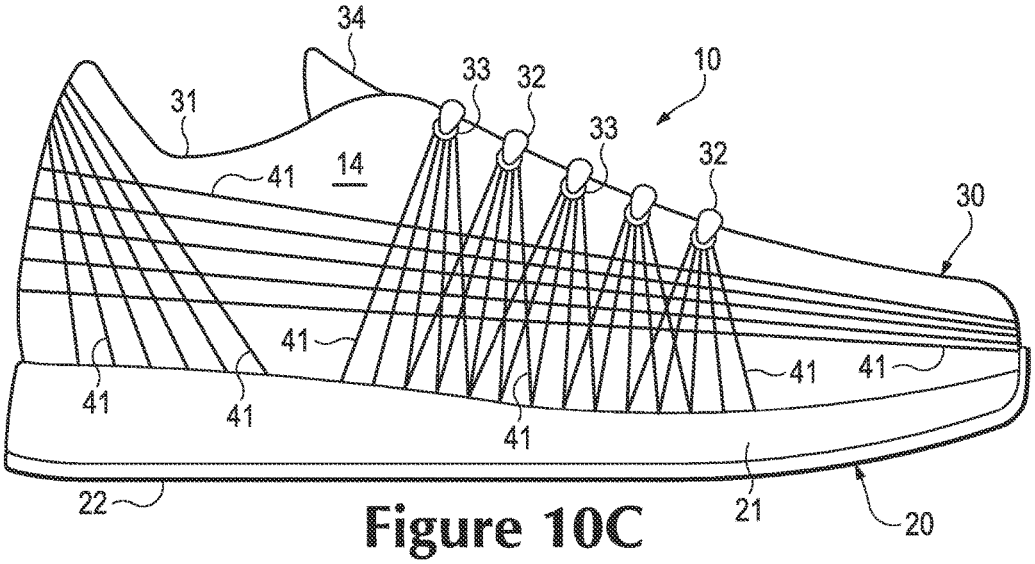
Figure 10D:
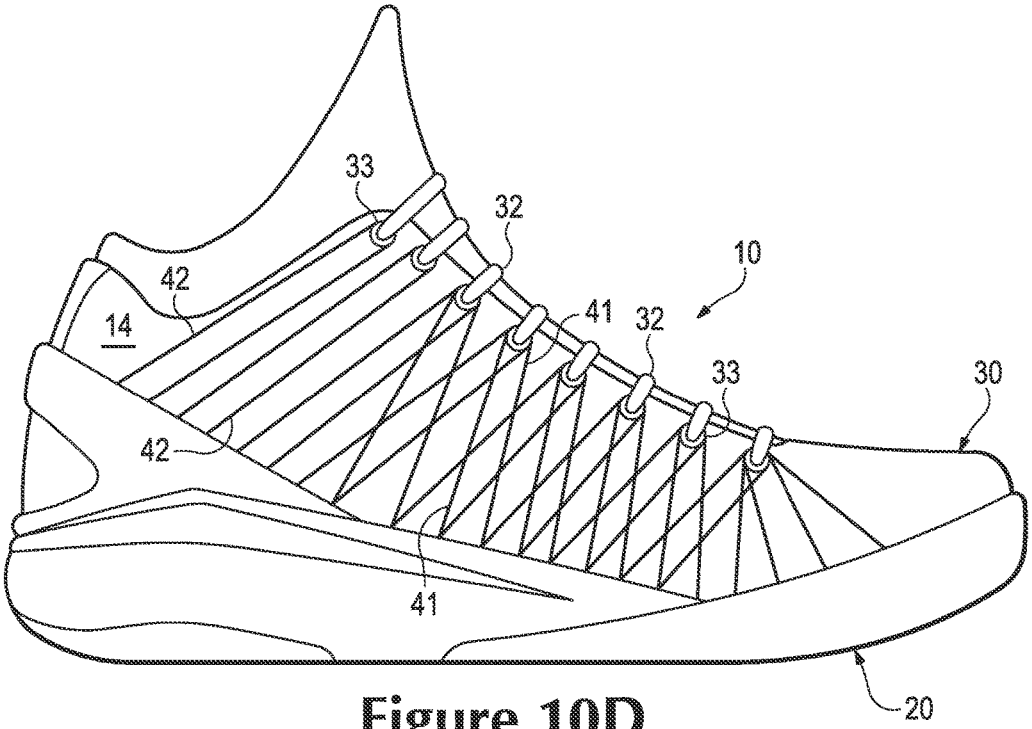

Additional configurations of footwear 10 will now be discussed. Referring to FIG. 10A, strands 41 extend in a variety of directions from lace apertures 33 to sole structure 20. FIG. 10B depicts a configuration where strands 41 extend downward from only some of lace apertures 33. A configuration that includes additional strands 41 in heel region 13, which may effectively form a heel counter, is depicted in FIG. 10C. In addition, various strands 41 extend longitudinally from forefoot region 11 to heel region 13. A basketball shoe incorporating strands 41 and 42 is depicted in FIG. 10D. Accordingly, the orientations, locations, and quantity of strands 41 and 42 may vary considerably, as well as the types of footwear incorporating strands 41 and 42.

CONCLUSION

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

What is claimed is:

1. An article of footwear having an upper and a sole structure secured to the upper, the upper comprising:

a base layer extending from a lace region of the upper to a lower region of the upper, the lace region defining a plurality of lace-receiving elements, and the lower region being where the sole structure is secured to the upper; and a plurality of strands extending from at least one of the plurality of lace-receiving elements in the lace region to the lower region, the plurality of strands being secured to the upper in a fixed position at the lace region and the lower region, the plurality of strands being unsecured for a distance of at least five centimeters in an area between the lace region and the lower region, and the plurality of strands having an elongate cross-sectional shape;

wherein the plurality of strands is configured to lay against the base layer in the area between the lace region and the lower region when the plurality of strands is placed in tension; and wherein the plurality of strands is configured to be spaced away from the base layer in the area between the lace region and the lower region when the plurality of strands is compressed.

2. The article of footwear according to claim 1, wherein two or more strands of the plurality of strands extend from the at least one of the plurality of lace-receiving elements in at least two different directions.

3. The article of footwear according to claim 1, wherein the plurality of lace-receiving elements comprises three or more lace-receiving elements; and wherein the plurality of strands extends from each of the plurality of lace-receiving elements to the lower region.

4. The article of footwear according to claim 1, wherein the plurality of lace-receiving elements comprises a first lace-receiving element and a second lace-receiving element;

wherein the plurality of strands extends from the first lace-receiving element to the lower region; and wherein the plurality of strands are absent from the second lace-receiving element.

5. The article of footwear according to claim 4, wherein the first lace-receiving element is located adjacent to the second lace-receiving element in the lace region of the upper.

6. The article of footwear according to claim 4, wherein the plurality of lace-receiving elements further comprises a third lace-receiving element; and wherein the plurality of strands extends from the third lace-receiving element to the lower region.

7. The article of footwear according to claim 6, wherein the second lace-receiving element is located between the first lace-receiving element and the third lace-receiving element in the lace region of the upper.

8. The article of footwear according to claim 6, wherein at least one strand of the plurality of strands extending from the first lace-receiving element crosses at least one strand of the plurality of strands extending from the third lace-receiving element.

9. The article of footwear according to claim 1, further comprising another plurality of strands extending around a heel region of the upper between a medial side and a lateral side of the article of footwear.

10. The article of footwear according to claim 1, wherein the plurality of lace-receiving elements comprises a first lace-receiving element and a second lace-receiving element;

wherein the plurality of strands extends from the first lace-receiving element to the lower region, including a first strand extending in a first direction and a second strand extending in a second direction; and wherein the plurality of strands extends from the second lace-receiving element to the lower region, including a third strand extending in a rearwardly direction towards a heel region of the article of footwear.

11. The article of footwear according to claim 10, wherein the second lace-receiving element is located adjacent to an ankle opening of the upper.

12. The article of footwear according to claim 10, wherein the second strand and the third strand extend to the lower region in a substantially similar direction.

13. The article of footwear according to claim 1, wherein the plurality of strands extends from each of the plurality of lace-receiving elements to the lower region.

14. An article of footwear having an upper and a sole structure secured to the upper, the upper comprising:

a base layer extending from a lace region of the upper to a lower region of the upper, the lace region defining a plurality of lace-receiving elements, and the lower region being where the sole structure is secured to the upper; and a plurality of strands extending from each of at least two of the plurality of lace-receiving elements in the lace region to the lower region, the plurality of strands being secured to the upper in a fixed position at the lace region and the lower region, the plurality of strands being unsecured for a distance of at least five centimeters in an area between the lace region and the lower region, and the strands having an elongate cross-sectional shape that includes (a) a pair of facing surfaces located opposite each other and (b) a pair of end surfaces located opposite each other, a dimension between the facing surfaces defining a thickness, and a dimension between the end surfaces defining a width, the width being greater than the thickness, and one of the facing surfaces being oriented to contact the base layer;

wherein one of the facing surfaces of the plurality of strands is configured to lay against the base layer in the area between the lace region and the lower region when the plurality of strands is placed in tension; and wherein said one of the facing surfaces of the plurality of strands is configured to be spaced away from the base layer in the area between the lace region and the lower region when the plurality of strands is compressed.

15. The article of footwear according to claim 14, wherein the plurality of strands include two or more strands extending from each of the at least two of the plurality of lace-receiving elements in the lace region to the lower region; and wherein the two or more strands extend to the lower region in different directions.

16. The article of footwear according to claim 14, wherein the at least two of the plurality of lace-receiving elements comprises a first lace-receiving element and a second lace-receiving element;

wherein the plurality of strands extends from each of the first lace-receiving element and the second lace-receiving element to the lower region; and wherein the plurality of strands are absent from a third lace-receiving element.

17. The article of footwear according to claim 16, wherein the third lace-receiving element is located between the first lace-receiving element and the second lace-receiving element in the lace region of the upper.

18. The article of footwear according to claim 14, further comprising another plurality of strands extending around a heel region of the upper between a medial side and a lateral side of the article of footwear.

19. The article of footwear according to claim 14, wherein the at least two of the plurality of lace-receiving elements comprises a first lace-receiving element and a second lace-receiving element;

wherein the plurality of strands extends from the first lace-receiving element to the lower region, including a first strand extending in a first direction and a second strand extending in a second direction; and wherein the plurality of strands extends from the second lace-receiving element to the lower region, including a third strand extending in a rearwardly direction towards a heel region of the article of footwear.

20. The article of footwear according to claim 19, wherein the second lace-receiving element is located adjacent to an ankle opening of the upper.

* * * * *